US007635232B2

(12) United States Patent
Bauer et al.

(10) Patent No.: US 7,635,232 B2
(45) Date of Patent: Dec. 22, 2009

(54) APPLICATION DEVICE, IN PARTICULAR MAKEUP DEVICE

(75) Inventors: Reinhard Bauer, Rosstal (DE); Herbert Brendel, Nürnberg (DE); Thomas Heidenreiter, Kalchreuth (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 712 days.

(21) Appl. No.: 10/534,570

(22) PCT Filed: Sep. 25, 2003

(86) PCT No.: PCT/EP03/10672

§ 371 (c)(1),
(2), (4) Date: Aug. 8, 2005

(87) PCT Pub. No.: WO2004/045336

PCT Pub. Date: Jun. 3, 2004

(65) Prior Publication Data

US 2006/0051154 A1 Mar. 9, 2006

(30) Foreign Application Priority Data

Nov. 18, 2002 (DE) ..... 202 17 821 U
Sep. 12, 2003 (EP) ..... 03020798

(51) Int. Cl.
*A46B 11/00* (2006.01)

(52) U.S. Cl. ..... 401/123; 401/122; 401/125; 401/175; 401/281

(58) Field of Classification Search ..... 401/121–125, 401/175, 129, 172, 174, 277, 281; 132/218, 132/308, 320
See application file for complete search history.

(56) References Cited

U.S. PATENT DOCUMENTS

| | | | | | |
|---|---|---|---|---|---|
| 1,694,812 | A | * | 12/1928 | Floyd | 401/175 |
| 3,008,172 | A | * | 11/1961 | Thompson | 401/175 |
| 3,100,315 | A | * | 8/1963 | Laxalt | 401/175 |
| 3,739,789 | A | * | 6/1973 | Cataneo et al. | 401/175 |
| 5,011,317 | A | | 4/1991 | Gueret | |
| 5,074,693 | A | | 12/1991 | Iizuka et al. | |
| 5,339,841 | A | | 8/1994 | Gueret | |
| 5,372,444 | A | * | 12/1994 | Lhuisset | 401/175 |
| 5,851,079 | A | | 12/1998 | Horstman et al. | |
| 5,890,828 | A | | 4/1999 | Gueret | |
| 6,142,692 | A | | 11/2000 | Garcia | |
| 6,305,863 | B1 | | 10/2001 | Gueret | |
| 6,345,626 | B1 | | 2/2002 | Bouix | |

FOREIGN PATENT DOCUMENTS

| | | |
|---|---|---|
| DE | 39 23 828 | 12/1990 |
| DE | 44 34 793 | 4/1996 |
| JP | 63-11367 | 1/1988 |
| JP | 63-185485 | 11/1988 |
| JP | 3-13914 | 2/1991 |
| JP | 4-130713 | 11/1992 |

* cited by examiner

*Primary Examiner*—Tuan N Nguyen
(74) *Attorney, Agent, or Firm*—Bachman & LaPointe, P.C.

(57) ABSTRACT

An application device, in particular a makeup device, comprising a first region (30) for storing a fluid, gel-like or pasty product. There is provided a second region (34) for loading an applicator (14) with the cosmetic product, the second region being separated from the first region.

13 Claims, 2 Drawing Sheets

APPLICATION DEVICE, IN PARTICULAR MAKEUP DEVICE

BACKGROUND OF THE INVENTION

The invention concerns an application device, in particular a makeup device comprising a first region for storing a fluid, gel-like or pasty product. In that respect the invention relates in particular to a makeup device which is used in conjunction with eyelash makeup or mascara or the like. The invention however is not limited to that use.

Application devices of the above-indicated kind are known. These conventionally involve what are known as dip systems in which an application member or applicator is dipped into the first region to load the applicator with the product. Those conventional devices need improvement:

Due to the applicator being dipped into the product the product can be contaminated, in particular with germs, as a result of which it can become unusable. In order that the applicator can dip into the first region at all, a comparatively large opening is required, and that involves a comparatively large surface area for air to act thereon, in regard to the stored product. That gives rise to the risk of the stored product drying out or ageing. In addition, in the case of viscous products the applicator, after being dipped thereinto, leaves behind a crater-like depression which entails an increase in the surface area open to attack by the air. In addition, in view of the crater-like depression, a lady user could be induced to "help things along" for example with water because she had the impression that the product had dried out, thereby involving serious risks of contamination. Added to that is the fact that, when loading product for example onto an applicator in brush form having a stem, the product can also pass onto the stem, whereby the stem becomes increasingly fouled. In addition precise metering is not possible. It is also to be observed that wiper devices which are conventionally provided are admittedly operative radially but not axially, and for that reason lumps of the product remain on the applicator, and they result in overapplication and smudging in use, for example when applying makeup. If those lumps are wiped off for example on a paper tissue, then product is wasted. Finally a problem is also to be found in the fact that dried-out crumbly residues which are to be found under some circumstances on the applicator are mixed into the stored product when the applicator is dipped, or dipped again, into the first region.

The object of the present invention is to improve the device of the kind set forth in the opening part of this specification in such a way that the above-described disadvantages and problems are eliminated.

SUMMARY OF THE INVENTION

The object is attained in accordance with the invention by a second region for loading an applicator with the product, wherein the second region is separated from the first region.

In accordance with the invention, the operation of loading an applicator does not take place within the storage region for the product. That eliminates any "retroaction". In particular the problem of the stored product being contaminated with germs no longer arises. In addition there does not have to be any access, corresponding to the size of the applicator, to the product storage means (first region), so that the risk of the product drying out or ageing because of excessively large surface areas affording access to the air no longer occurs. There is also no risk of a stem of an applicator being unintentionally smeared with the product. Finally there is no possibility of crumbly residues passing into the first region.

In accordance with a particularly preferred embodiment of the invention there is provided at least one feed passage for feeding product from the first region to the second region.

In a further preferred feature the device according to the invention has a conveyor means for conveying the product from the first region into the second region.

In that respect the conveyor means can be in principle of any desired configuration. In accordance with a particularly preferred embodiment of the invention however it is adapted to urge the product from the first region with the second region and/or to increase the pressure in the first region relative to the pressure in the second region. When the above-mentioned feed passage is provided, the product is conveyed through the feed passage from the first region into the second region upon actuation of the conveyor means.

In accordance with a particularly preferred embodiment of the invention it is provided that the applicator can assume a rest position and a working position and movement of the applicator from the rest position into the working position causes actuation of the conveyor means. In other words, this virtually provides an "automatic" system so that, for loading the applicator with the product, it is sufficient to move the applicator from the rest position into the working position.

In accordance with a particularly preferred embodiment of the invention the device has a receiving region, which is separated from the first region, for the applicator in the rest position.

That receiving region can be for example of such a configuration that the applicator is protected from being adversely affected in the rest position.

In a further preferred feature in that case the second region adjoins the receiving region in such a way that the applicator passes the second region (loading region) when it is removed from the receiving region for it to move into the working position.

That configuration further contributes to the "automatic" loading of the applicator with the product, which has already been mentioned above.

In accordance with a preferred embodiment of the invention the device has: a screwthread which has a first screwthread element and a second screwthread element and the actuation of which causes movement of the applicator from the rest position into the working position, and a coupling for coupling the first screwthread element to the conveyor means.

The above-mentioned coupling serves in particular to embody the "automatic" system already mentioned above.

The coupling preferably involves a one-way coupling.

That arrangement ensures that the conveyor means is actuated only when the applicator is moved from the rest position into the working position, but not when the applicator is moved from the working position into the rest position.

As a particularly simple feature it is preferred in accordance with the invention that the coupling is a ratchet coupling.

In order to ensure simplicity of actuation in accordance with a further preferred embodiment of the invention the coupling has at least one elastic ratchet element.

In a further preferred feature the conveyor means has a piston-cylinder device.

In accordance with a further preferred embodiment of the invention the conveyor means has a rotary drive.

That means that the conveyor means can be embodied in a particularly simple manner.

In that respect the rotary drive in a further preferred feature has a hollow spindle, the internal space of which is designed to receive and/or pass therethrough the applicator and on the outside surface of which is provided a screwthread. That makes it possible to provide a particularly compact structure.

Preferably there is provided a wiper for wiping product residues from the applicator after use thereof. The product residues can be fed to a reservoir for old material after the wiping operation.

In accordance with a further preferred feature the invention provides not only the application device in accordance with the foregoing configurations but also such an application device in combination with an applicator for the product.

In addition the invention also relates to the applicator for an application device in accordance with the foregoing configurations.

BRIEF DESCRIPTION OF THE DRAWINGS

The invention is described in greater detail hereinafter by means of a preferred embodiment by way of example with reference to the accompanying drawing in which.

DETAILED DESCRIPTION

Figure 1:
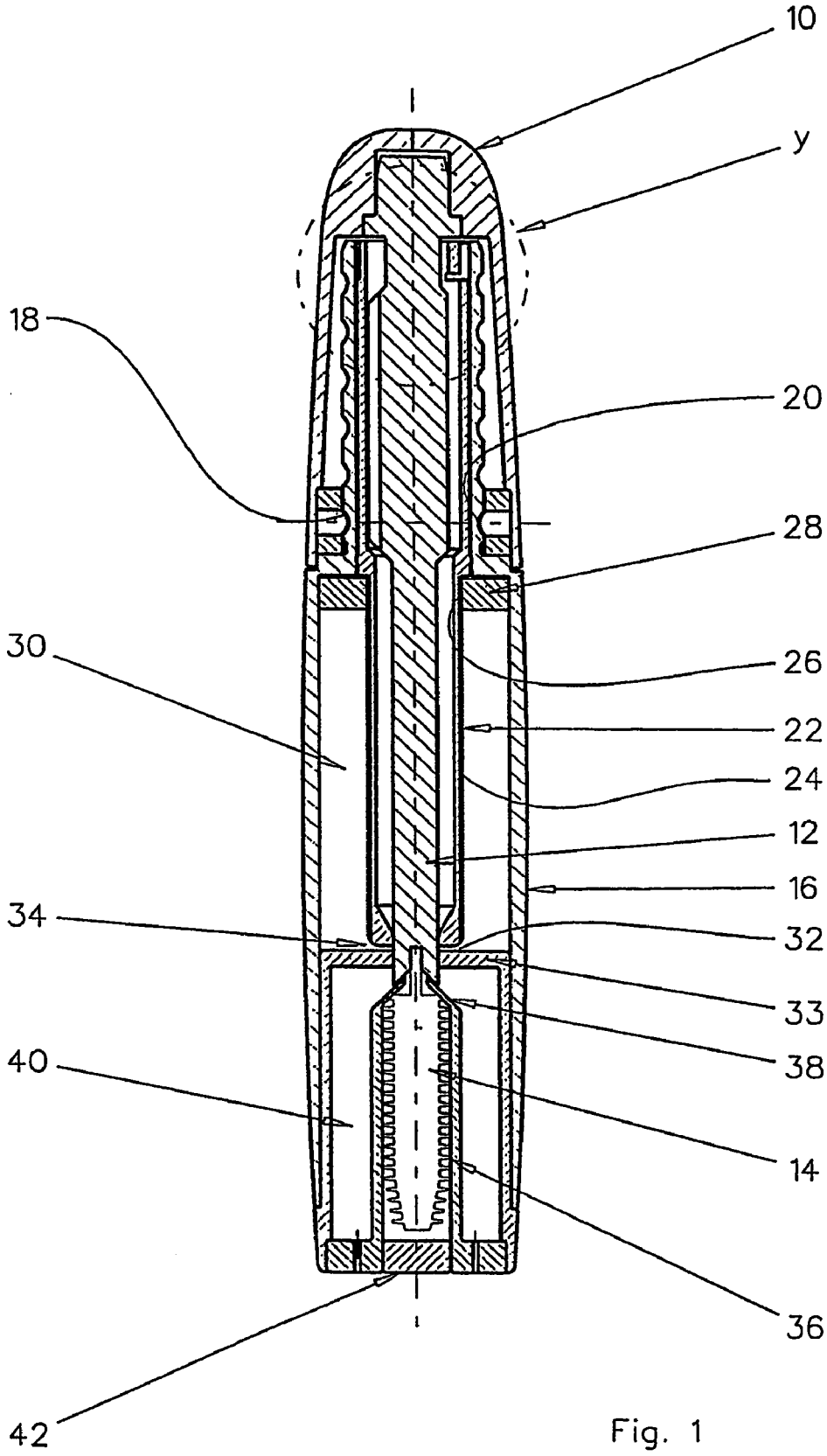
FIG. 1 shows a diagrammatic view in longitudinal section of a makeup device in accordance with a preferred embodiment of the invention.

The application device illustrated in the drawing is a makeup device. It has a handle portion 10 in which a stem 12 with an applicator 14 at its free end is fixedly inserted. In the rest position shown in FIG. 1 the handle portion 10 is screwed onto a container 16. For that purpose the container 16 has a male screwthread 18. The handle portion has a screwthread 20. A hollow spindle 22 is fitted rotatably into the container 16. The hollow spindle 22 has a male screwthread 24 meshing with a female screwthread 26 of a piston 28. The piston 28 is admittedly axially displaceable with respect to the container 16 but it is held non-rotatably.

Provided in the central region of the container 16 is a storage means 30 for a cosmetic product, for example mascara. A feed passage 32 directly above a chamber bottom 33 communicates the storage means 30 with a loading region 34.

In the rest position shown in FIG. 1 the applicator 14 which for example is in the form of a brush is disposed in a receiving region 36. Disposed between the receiving region 36 and the loading region 34 is a wiper 38 for cleaning the applicator after it has been used. The receiving region 36 is surrounded by a reservoir 40 for old material. The lower closure part of the container is formed by an end portion 42.

Figure 2:
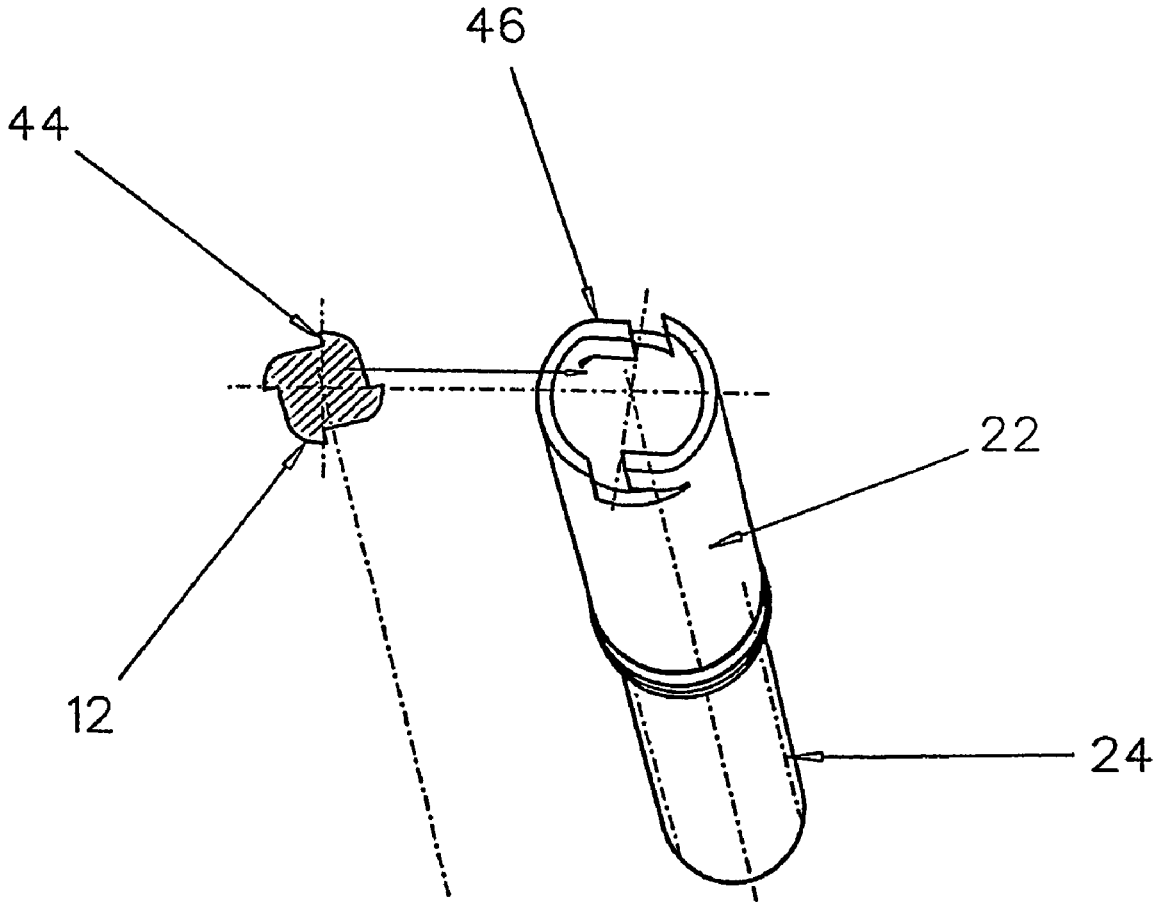
FIG. 2 shows a diagrammatic perspective view of the detail y in FIG. 1.

As can be seen from FIG. 2 the stem 12 in cross-section is of a contour with four ratchet projections of which one is identified by way of example by reference numeral 44. The hollow spindle 22 is provided with an elastically resilient ratchet tongue 46. The number of ratchet projections 44 is not restricted to four. It is preferably in the range of from one to six. In the same manner it is also possible to provide a plurality of ratchet tongues 46.

The mode of operation of the makeup device illustrated in the drawing is as follows:

When the handle portion 10 is unscrewed from the container 16, which requires a rotary movement of the handle portion 10 relative to the container 16, then the stem 12 which rotates with the handle portion 10 entrains the hollow spindle 22 by way of the ratchet projections 44 and the ratchet tongue 46. The result of that rotary movement of the hollow spindle 22 is that the piston 28 is displaced downwardly in FIG. 1 by way of the pair of screwthreads 24/26. In the illustrated embodiment the pitch of the pair of screwthreads 24/26 is about 0.4 mm, for which reason the piston 28 is moved downwardly by the specified 0.4 mm in FIG. 1. As a result mascara is urged out of the storage means 30 into the loading region 34 by way of the feed passage 32.

Because of the handle portion 10 being unscrewed from the container 16 however, simultaneously with the above-described downward movement of the piston 28 the applicator element 14 is moved upwardly in FIG. 1 past the wiper 38 and through the loading region 34. In that loading region it is loaded with mascara by way of the feed passage 32.

As the piston 28 moves downwardly precisely by the above-mentioned stroke movement, it is possible to provide for accurate portioning of the mascara when loading the applicator 14. If more or less is to be loaded onto the applicator 14, it is only necessary to alter the ratio of the pitches of the pairs of screwthreads 24/26 and 18/20. A piston movement of 0.2-0.7 mm has proven to be advantageous.

When, after application of the cosmetic product, the handle portion 10 is screwed onto the container 16 again, the coupling formed by the elements 44 and 46 slips, so that the piston 28 does not move. The wiper 38 wipes mascara residues from the applicator 14. The residues are collected in the reservoir 40 for old material. Accordingly the wiper 38 acts as a cleaning device for the applicator 14, that is to say the applicator 14 is cleaned by the wiper before the next operation of loading it with mascara.

The features disclosed in the foregoing description, the claims and the drawing can be essential for implementation of the invention in the various embodiments thereof both individually and also in any combinations.

The invention claimed is:

1. An application device, in particular a makeup device comprising:

a container (16) wherein the applicator (14) has a rest position and a working position;

an applicator (14) removably attached to the container (16);

the container (16) has a first region (30) inside the container for storing a product and a second region (34) inside the container for loading the applicator (14) with the product, wherein the second region (34) is separated from the first region (30);

a receiving region (36), which is separated from the first region (3), for receiving the applicator (20) when the applicator is located in the container in the rest position;

a reservoir (40) surrounding the receiving region (36) defined in part by a chamber bottom (33) which separates the first region (30) from the reservoir (40); and a radially extending feed passage (32) defined in part by the chamber bottom (33) communicates the product from the first region (30) to the second region (34).

2. The device as set forth in claim 1, further comprising a conveyor means (28) for conveying the product from the first region (30) into the second region (34).

3. The device as set forth in claim 1, further comprising a conveyor means (28) for displacing the product from the first region (30) into the second region (34) and to increase the pressure in the first region (30) relative to the pressure in the second region (34).

4. The device as set forth in claim 2, wherein the applicator (14) has a rest position and a working position wherein movement of the applicator (14) from the rest position into the working position causes actuation of the conveyor means (28).

5. The device as set forth in claim 1, wherein the second region (34) adjoins the receiving region (36) such that the applicator (14) passes the second region (34) when it is removed from the receiving region (36) for moving the applicator into the working position.

6. The device as set forth in claim 4, further comprising a screwthread which has a first screwthread element (20) and a second screwthread element (18) for movement of the applicator (14) from the rest position into the working position, and a coupling (44, 46) for coupling the first screwthread element (20) to the conveyor means (28).

7. The device as set forth in claim 6, wherein the coupling (44, 46) is a one-way coupling.

8. The device as set forth in claim 6, wherein the coupling (44, 46) is a ratchet coupling.

9. The device as set forth in claim 8, wherein the coupling (44, 46) has at least one elastic ratchet element (46).

10. The device as set forth in claim 3, wherein the conveyor means (28) has a piston-cylinder device.

11. The device as set forth in claim 10, wherein the conveyor means (28) has a rotary drive (22, 24, 26).

12. The device as set forth in claim 11, wherein the rotary drive (22, 24, 26) has a hollow spindle (22) having an internal space, wherein the internal space is designed for receiving and/or passing therethrough the applicator (14) and on the outside surface of which is provided a screwthread (24).

13. The device as set forth in claim 1, further comprising a wiper (38) for wiping product from the applicator (14) after use of the applicator (14), wherein the wiped product is received in the reservoir (40).

* * * * *

UNITED STATES PATENT AND TRADEMARK OFFICE

CERTIFICATE OF CORRECTION

PATENT NO. : 7,635,232 B2
APPLICATION NO. : 10/534570
DATED : December 22, 2009
INVENTOR(S) : Bauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 967 days.

Signed and Sealed this

Twenty-first Day of December, 2010

David J. Kappos

David J. Kappos
*Director of the United States Patent and Trademark Office*